US007814994B2

(12) United States Patent
Franzén

(10) Patent No.: US 7,814,994 B2
(45) Date of Patent: Oct. 19, 2010

(54) DRILL ROD SUPPORT, AND DRILL ROD SUPPORT HALF

(75) Inventor: Håkan Franzén, Hallsberg (SE)

(73) Assignee: Atlas Copco Rock Drills AB, Orebro (SE)

( * ) Notice: Subject to any disclaimer, the term of this patent is extended or adjusted under 35 U.S.C. 154(b) by 142 days.

(21) Appl. No.: 11/795,880

(22) PCT Filed: Feb. 28, 2006

(86) PCT No.: PCT/SE2006/000262

§ 371 (c)(1),
(2), (4) Date: Jul. 24, 2007

(87) PCT Pub. No.: WO2006/093456

PCT Pub. Date: Sep. 8, 2006

(65) Prior Publication Data

US 2008/0093126 A1 Apr. 24, 2008

(30) Foreign Application Priority Data

Mar. 2, 2005 (SE) ..... 0500467

(51) Int. Cl.
*E21B 15/00* (2006.01)

(52) U.S. Cl. ..... 175/220; 173/184

(58) Field of Classification Search ..... 81/57.15, 81/57.24, 57.33, 57.35, 57.4; 248/511, 512, 248/519, 523, 530; 175/220; 166/379, 85.5; 173/184; 384/24
See application file for complete search history.

(56) References Cited

U.S. PATENT DOCUMENTS 818,794 A * 4/1906 Sheridan ..... 269/165
1,232,707 A * 7/1917 Moon ..... 81/57.35
2,150,611 A * 3/1939 Speck ..... 81/57.15
2,206,185 A * 7/1940 Graham et al. ..... 166/85.5
2,661,189 A * 12/1953 Gillerstrom ..... 384/24
2,828,109 A * 3/1958 Dellner ..... 384/24
4,111,388 A * 9/1978 Presley ..... 248/49
4,440,536 A * 4/1984 Scaggs ..... 414/22.51
4,505,614 A * 3/1985 Anschutz ..... 405/195.1
4,721,171 A 1/1988 Leppanen
4,733,991 A * 3/1988 Myers ..... 405/224.2
5,595,248 A * 1/1997 Denny ..... 166/379

(Continued)

FOREIGN PATENT DOCUMENTS

DE 2238232 5/1973

(Continued)

*Primary Examiner*—David J Bagnell
*Assistant Examiner*—Blake Michener
(74) *Attorney, Agent, or Firm*—Mark P. Stone

(57) ABSTRACT

Drill rod support (10) comprising means capable of moving two opposing drill rod support halves (20), each half (20) comprising a surface (21) for direct contact with the drill string (30), and the half being provided with a recess (23) capable of forming a drill string opening (22) with an opposing drill rod support half (20), the recess (23) being generally V-shaped, for enabling guiding of drill strings (30) of different shape and dimension. The invention is characterized in that the drill rod support halves (20) are movable to and from each other, for enabling contact with the drill string (30). The invention also relates to a drill rod support half (20) for use in such drill rod support.

6 Claims, 3 Drawing Sheets

U.S. PATENT DOCUMENTS

Figure 1:
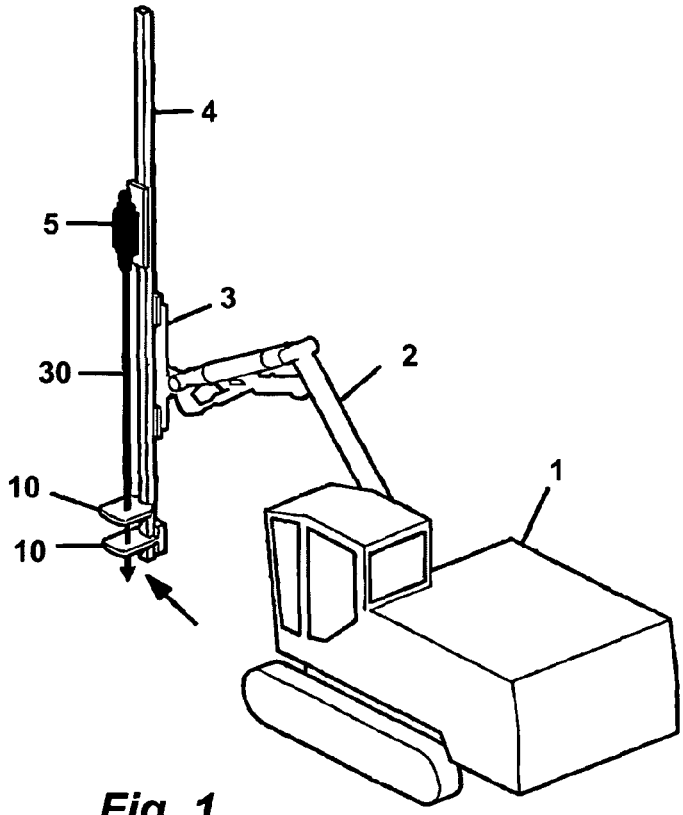
Fig. 1 PRIOR ART

| | | | | |
|---|---|---|---|---|
| 5,685,518 | A * | 11/1997 | Fox et al. | 248/523 |
| 6,099,058 | A * | 8/2000 | Asai et al. | 294/103.1 |
| 6,227,311 | B1 * | 5/2001 | Osadchuk | 175/53 |
| 6,260,625 | B1 * | 7/2001 | Phan et al. | 166/355 |
| 6,276,238 | B1 * | 8/2001 | Junck et al. | 81/57.34 |
| 6,517,042 | B1 * | 2/2003 | Mlakar et al. | 248/523 |
| 6,860,343 | B2 * | 3/2005 | Jonsson et al. | 175/220 |
| 6,955,224 | B2 * | 10/2005 | Watson | 166/379 |
| 7,111,676 | B2 * | 9/2006 | Drzewiecki | 166/85.5 |
| 7,357,184 | B2 * | 4/2008 | Patton et al. | 166/341 |
| 7,377,472 | B2 * | 5/2008 | Brown et al. | 248/74.1 |
| 2006/0213655 | A1 * | 9/2006 | Huddleston | 166/85.5 |
| 2008/0035826 | A1 * | 2/2008 | Clores et al. | 248/523 |
| 2009/0166092 | A1 * | 7/2009 | Jones | 175/220 |

FOREIGN PATENT DOCUMENTS

| | | |
|---|---|---|
| EP | 0387017 | 9/1990 |

* cited by examiner

DRILL ROD SUPPORT, AND DRILL ROD SUPPORT HALF

TECHNICAL FIELD

The present invention relates to a drill rod support for guiding a drill string of a drill rig, especially a rock drill rig, in accordance with the independent claim. The present invention also relates to a drill rod support half for use in such drill rod support.

BACKGROUND OF INVENTION

Generally, a rock drill rig (FIG. 1) comprises a movable carrier, a boom and a feed beam connected to the boom via e.g. a feed beam holder. A drilling machine is movable along the feed beam, affecting the drill string to be forced into the ground. The drill string comprises the drill point (drill bit) and the joined rods.

When drilling relatively deep holes, it is important that the drill hole does not deviate from the intended direction, since a deviation may have a negative effect on the final result depending on what the hole is to be used for. One or several drill rod supports are used to guide the drill string, thereby preventing the drill string from deviating.

A drill rod support should not be confused with a clamping device. Drill rod supports are used for guiding the drill string during drilling, on conditions of low friction between drill string and rod support. Whereas clamping devices, such as DE 19909860 and JP 2003 074286, are used for loosening or tightening of the rods when they are removed from the drilled hole, and hence designed to clamp tight around the rods (high friction).

Generally, a drill rod support comprises a pair of support halves. The halves can be moved to and from each other to be opened and closed respectively around the drill string. When the support halves are in their closed position, they are in contact with the drill string via the surface of the recesses, thus guiding (centring) the drill string, but not clamping the drill string.

The recesses of known drill rod support halves form an opening adapted to fit the drill string, by shape and dimension. A common form of recess of the support halves is essentially semi-circular creating a principally circular opening, adapted to fit drill strings with a circular cross section (shown in FIG. 2A).

There are also drill rod support halves which are especially adapted for drill strings with polygonal cross sections (e.g. JP 2003 053724). These halves can thus only be used for a specific rod form and dimension.

A major drawback of known drill rod support halves in that they are adjusted to fit a specific drill string of a specific dimension and shape. One problem with support halves being adapted to fit a certain drill string is, that the drill rod support is subjected to heavy vibration, the drill string and stone dust etc. causing wear of the drill rod support and especially of the drill rod support halves. The fit is satisfactory when the halves are new, but as the support halves are worn, especially by the rotating drill string, the fit between the support halves and the drill string is impaired (shown in FIG. 2B), resulting in poorer guiding. The guiding is worsened the more the halves are worn. The support halves must then be exchanged to maintain adequate guiding of the drill string. Frequent exchanges are time-consuming and increase the costs for equipment.

Another problem in using drill rod support halves adapted to fit a certain drill string is that it results in time consuming exchange of support halves for different strings.

BRIEF DESCRIPTION

The main object of the present invention is to obtain a drill rod support half that can be used for a longer period of time and for different rods, i.e. a support half that not needs to be exchanged as often due to wear or use of different rods. This is solved by the features set forth in the characterizing portion of the independent claim. Preferred embodiments are set forth in the dependent claims.

According to a main aspect, the present invention relates to a drill rod support half comprising a surface for direct contact with the drill string, and the half being provided with a recess capable of forming a drill string opening with an opposing drill rod support half. The invention is characterized in that the recess is generally V-shaped, for enabling guiding of drill strings of different shape and dimension.

With a support half according to the invention, arranged with a generally V-shaped recess, the same set of halves can be used for drill strings of different sizes by adjusting the distance between the halves, while keeping the structure of the half simple from a manufacturing viewpoint. Furthermore, whereupon the halves are worn by the drill string, the halves can also be brought together, with continuous guiding of the drill string.

These and other aspects of and advantages with the present invention, will be apparent from the detailed description and the accompanying drawings.

SHORT DESCRIPTION OF DRAWINGS

Figure 2A:
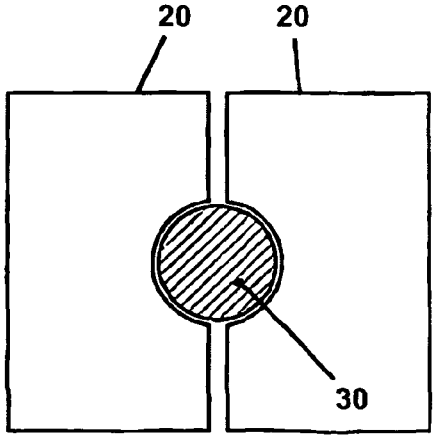
Fig. 2A PRIOR ART
Figure 2B:
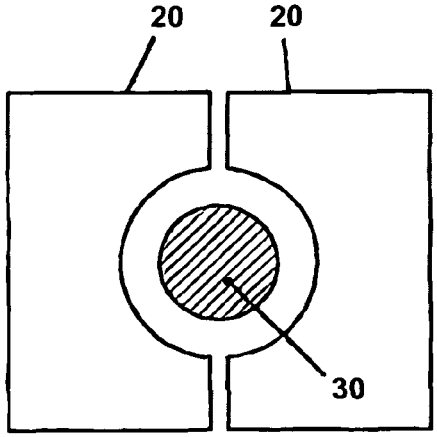
Fig. 2B PRIOR ART
Figure 3A:
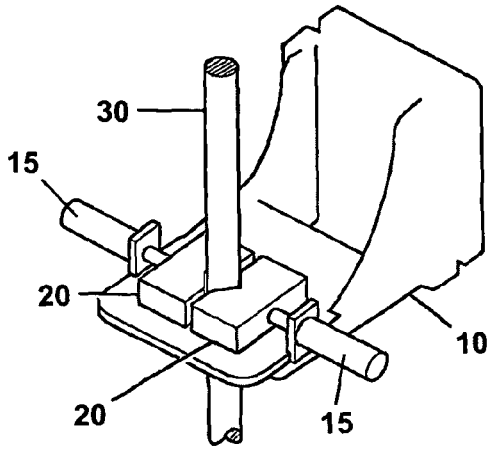
Figure 4A:
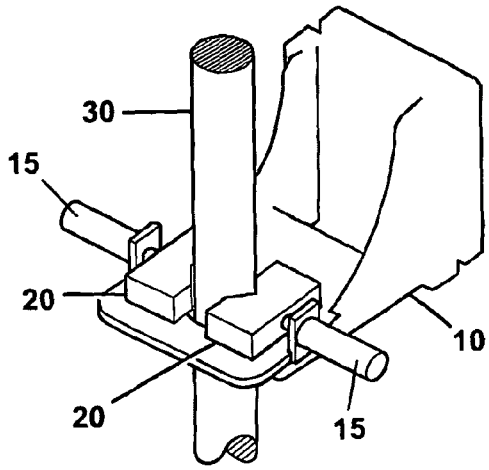
Figure 3B:
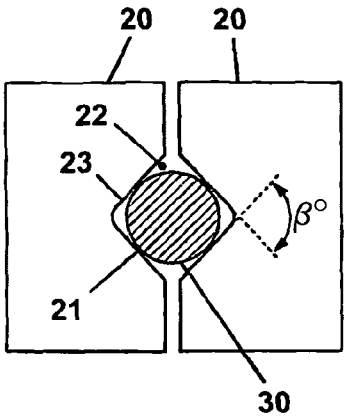
Figure 4B:
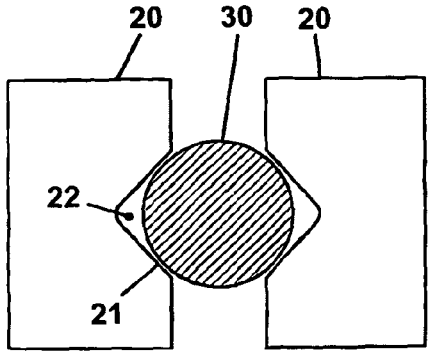
Figure 5A:
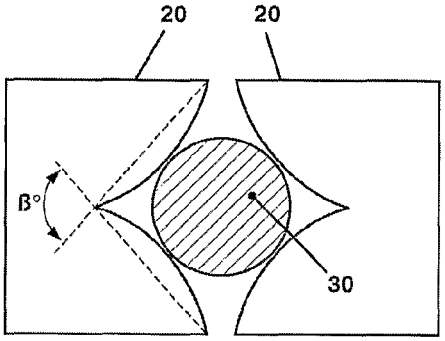
Figure 5B:
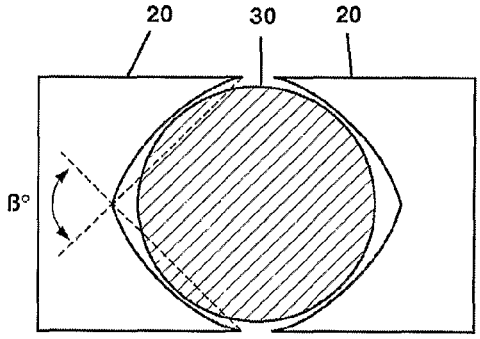
Figure 6:
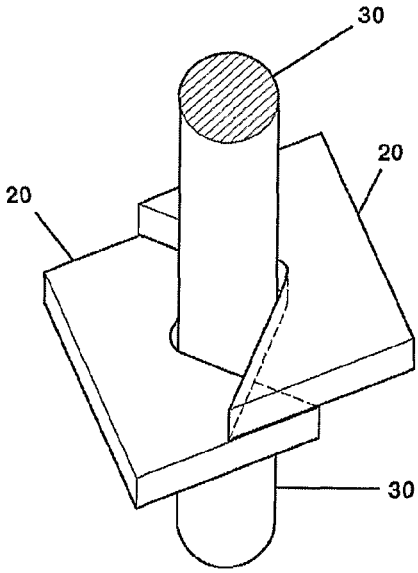

In the detailed description of the present invention reference will be made to the accompanying drawings, wherein FIG. 1 shows a schematic view of a rock drill rig, FIG. 2A shows a schematic view of an example of prior art unworn support halves having semi-circular recesses in a closed position around a drill rod, FIG. 2B shows the halves shown in FIG. 2A when the halves are worn, FIG. 3A shows a perspective view of a drill rod support with support halves according to the invention in closed position around a drill string with a small diameter, FIG. 3B shows a schematic view of the halves and the drill rod in FIG. 3A, FIG. 4A shows a perspective view of a drill rod support with the support halves in FIG. 3A in closed position around a drill string with a larger diameter than in FIG. 3A, FIG. 4B shows a schematic view of the halves and the drill rod in FIG. 4A, FIG. 5A shows support halves according to another embodiment of the invention, the sides of the recesses being convex, FIG. 5B shows support halves according to another embodiment of the invention, the sides of the recesses being concave, FIG. 6 shows a drill rod support according to another embodiment of the invention with displaced halves.

DETAILED DESCRIPTION

FIG. 1 shows a schematic view of a rock drill rig comprising a movable carrier 1, a boom 2 and a feed beam 4 connected to the boom via a feed beam holder 3. A drilling machine 5 is movably attached to the feed beam 4, and is movable along the feed beam 4 to affect the drill string 30. The drill string 30 comprises the drill point (drill bit) and the joined rods.

The feed beam 4 has a drill end 41 from which the drill point protrudes at drilling. Generally, drill rigs are arranged with at least one drill rod support 10 near the drill end 41 of the feed beam 4 for guiding the drill string 30. The drill rig in FIG. 1 is shown with two drill rod supports 10.

FIGS. 3A and 4A show a drill rod support 10 comprising two drill rod support halves 20 according to the invention. The support halves 20 are movable to and from each other, in a manner known per se by means of e.g. hydraulic or pneumatic cylinders, generally illustrated by reference numeral 15.

between an open and a closed position. With reference to FIGS. 3B and 4B, the shown drill rod support halves 20 are in guiding position with a drill string 30 (closed position).

A drill rod support half 20 according to the invention comprises a surface 21 for direct contact with the drill string 30. The half 20 is provided with a recess 23 capable of forming a drill string opening 22 with an opposing drill rod support half 20. The drill rod support half 20 may be unitary.

The recess 23 is generally V-shaped, for enabling guiding of drill strings 30 of different shape and dimension. A drill rod support half 20 according to the invention having a V-shaped recess 23, may thus create a drill string opening 22 with an essentially rhombic shape, together with an opposing half 20 when the halves are moved together.

The sides of the generally V-shaped recess 23, may be rounded i.e. generally convex or concave (FIGS. 5A and 5B, exaggerated curve). For constructional reasons, the tip of the V may be somewhat rounded (shown in FIGS. 3B and 4B).

The larger angle, the less number of halves needs to be used for the range of rods. Still, there is a turning point, where a too large angle no longer gives a satisfactory guiding, depending on the dimension of the rods. Preferably, the angle β between the sides of the V-shaped recess 23 is in the range between 70° and 120°, and more preferably between 80° and 110°. Still more preferably, the angle β is in the range between 90° and 100°, and most preferably essentially 90°.

Using a pair of halves 20 with an angle β being about 100°, a range of rods with exterior diameters ranging from 51 to 178 mm, can be handled with only three different sets of halves. In comparison, earlier, the same range of exterior diameters demanded about 15 sets of halves; and for halves adapted to fit certain rods one set of halves for each dimension was used.

When the drilling is about to start, the drill string 30 is brought down through the drill rod support 10 towards the surface to be drilled, the drill rod support halves 20 are brought into contact with the drill string 30 (closed position), for guiding the drill string 30 during the drilling operation.

The distance between the support halves 20 arranged in the drill rod support 10 is adjustable for enabling guiding of different drill strings 30 (different form and/or size).

If the support halves are worn and a play arises between the drill string and the surface, e.g. due to strong forces, vibration and drill cuttings, the support halves 20 may be brought further together to keep contact with the drill string 30 and continue guiding the same.

If the dimension of the drill string 30 is decreased, or the respective surface 21 of the support halves 20 is worn, the support halves 20 may also be brought together to keep the fit with the drill string 30, and consequently brought apart to fit a drill string 30 with a larger dimension.

Generally, the opposing halves 20 are arranged in the same plane in the drill rod support 10. Alternatively, and as shown in FIG. 6, they may be arranged in different parallel planes in the drill rod support 10 to allow the support halves 20 to be pushed together even further, thus allowing handling of yet smaller dimensions.

The support half, and especially its surface for contact with the drill string, is preferably manufactured out of a material with considerable wear resistance and low friction against the drill string, such as plate, casting or any other suitable material.

It also possible to provide the half with inserts (i.e. welded into the half body or attached in any other suitable way) of any suitable wear resisting material such as steel, ceramics, polymers and the like, still maintaining the generally V-shaped form of the recess. The inserts may be replaceable.

The embodiments shown in the drawings and put forward in the description should not be considered restricting, only as exemplifying.

The invention claimed is:

1. A rock drilling drill rod support device comprising a drill rod support surface (10), two opposing drill rod support halves (20), and means for moving only said two opposing drill rod support halves (20) along a common plane defined by said drill rod support surface, said drill rod support surface defining an opening for receiving a drill string (30), each said drill rod support half (20) comprising a surface (21) for direct contact with said drill string (30) received in said opening in said drill rod support surface, and each said drill rod support half being provided with a recess (23) capable of forming a drill string opening (22) with an opposing said drill rod support half (20), the recess (23) being generally V-shaped, for enabling guiding of drill strings (30) of different shape and dimension, characterized in that at least the portion of each said drill rod support half (20) which contacts said drill string is formed from a material having a low coefficient of friction relative to said drill string received in said opening in said drill rod support surface to enable guiding of the drill string during drilling, and that the drill rod support halves (20) are continuously and parallelly displaceable to and from each other, for enabling contact with said drill string (30) received in said opening in said drill rod support surface, whereby the two drill rod support halves (20) enable guiding of drill strings of different shape and dimension.

2. The drill rod support device according to claim 1, characterized in that the means for moving comprises cylinders, by means of which the drill rod support halves (20) are movable to and from each other.

3. A rock drilling drill rod support device comprising a drill rod support surface, two opposing drill rod support halves, and means for moving only said two opposing drill rod support halves relative to each other, at least one of said drill rod support halves being movable on said drill rod support surface, said drill rod support surface defining an opening for receiving a drill string, each of said drill rod support halves comprising a surface for direct contact with said drill string, and each said drill rod support half being provided with a recess capable of forming a drill string opening with an opposing said drill rod support half, the recess being generally V-shaped, for enabling guiding of drill strings of different shape and dimension, characterized in that at least the portion of each said drill rod support half which contacts said drill string is formed from a material having a low coefficient of friction relative to said drill string received in said opening in said drill rod support surface to enable guiding of the drill string during drilling, and that the drill rod support halves are continuously and parallelly displaceable to and from each other, for enabling contact with said drill string received in said opening in said drill rod support surface, whereby the two drill rod support halves enable guiding of drill strings of different shapes and dimensions.

4. The drill rod support device according to claim 3, characterized in that the means for moving comprises cylinders, by means of which the drill rod support halves are movable to and from each other.

5. The drill rod support device according to claim 3, characterized in that the drill rod support halves are movable along the same plane.

6. The drill rod support device according to claim 3, characterized in that the drill rod support halves are movable along different parallel planes.

* * * * *